US006056676A

United States Patent [19]

Adams

[11] Patent Number: 6,056,676

[45] Date of Patent: May 2, 2000

[54] EXERCISE DEVICE AND METHOD OF USING SAME

[76] Inventor: Cleveophis Adams, 117 Rosebay Dr., Suite 22, Encinitas, Calif. 92024

[21] Appl. No.: 09/115,969

[22] Filed: Jul. 15, 1998

Related U.S. Application Data

[63] Continuation-in-part of application No. 09/015,603, Jan. 30, 1998.

[51] Int. Cl.[7] ..... A63B 21/02

[52] U.S. Cl. ..... 482/112; 482/125; 482/140; 482/126

[58] Field of Search ..... 482/112, 111, 482/140, 126, 128, 121

[56] References Cited

U.S. PATENT DOCUMENTS

| | | | |
|---|---|---|---|
| 5,069,448 | 12/1991 | Shyu | 482/112 |
| 5,071,119 | 12/1991 | Johnson | 482/112 |
| 5,232,425 | 8/1993 | Miller | 482/148 |
| 5,637,066 | 6/1997 | Chang | 482/140 |
| 5,695,436 | 12/1997 | Huang | 482/140 |
| 5,759,138 | 6/1998 | Boland | 482/140 |

*Primary Examiner*—Jerome W. Donnelly
*Attorney, Agent, or Firm*—Higgs,Fletcher& Mack LLP; Bernard L. Kleinke

[57] ABSTRACT

An inventive exercise device is disclosed for facilitating the strengthening of abdominal and back muscles, and includes a resistance member coupled between a lap engageable base and an arm positioning member. The arm positioning member helps to maintain the back of the user in a substantially upright position as the arm positioning member applies and releases reciprocatively and alternatingly in a substantially vertical path of travel of the upper body of the user against the force on the resistance member during repetitions of use of the device. The resistance member resists substantially vertical downward movement relative to the base member to enhance the development of muscle strength by enabling the upper body of the user to contract and expand reciprocatively vertically without leaning forwardly in a safe and effective manner. The exercise device may have at least one swivel connecting the arm positioning member to the base that allows the exercise device to be used while the user leans left or leans right, thus exercising auxiliary back muscles. Further, the swivel and a torso adjustment assembly allow the user to maintain a comfortable, safe, and effective exercise position.

19 Claims, 3 Drawing Sheets

EXERCISE DEVICE AND METHOD OF USING SAME

This application is a continuation-in-part of U.S. application Ser. No. 09/015,603 filed Jan. 30, 1998 and titled "Exercise Device and Method Of Using Same, which is incorporated herein by reference."

BACKGROUND OF THE INVENTION

1. Technical Field

The present invention relates in general to an exercise device and a novel method of using it. The invention more particularly relates to a device for exercising the abdominal and lower back muscles while reducing the risk of muscle injury according to a novel method.

2. Background Art

There are many types of exercise devices for exercising the abdominal and lower back muscles of a user. For example, reference may be made to the following U.S. Pat. Nos.: 5,005,832; 5,071,119; 5,171,201; 5,224,914; 5,441,473; 5,492,524; and 5,588,941.

In general, the exercise devices disclosed in the aforementioned U.S. patents facilitated the performance of an abdominal or stomach "crunch" exercise. The crunch exercise is performed by bending at the waist, wherein the abdominal and lower back muscles are contracted to bring the upper torso toward the thighs. The abdominal and lower back muscles are subsequently relaxed slowly to enable the upper torso to return to its starting position. By repeating the exercise for a number of repetitions, the strength of the abdominal and lower back muscles can be significantly increased. U.S. Pat. No. 5,071,119 described an abdominal exercise device for a user sitting in a chair. The device included a spring loaded piston having a push bar supported at one end. In use, the piston engaged a ground surface in front of the seated user, and the arms of the user were brought up to engage the push bar. Starting from an upright position, the body of the user was bent at the waist while contracting the abdominal and lower back muscles to bring the upper torso of the user forwardly toward the thighs of the user. The piston resisted the forward bending movement of the torso, causing the muscles to exert an even greater amount of energy than would otherwise be required to perform the abdominal crunch. As a result, the abdominal and lower back muscles worked harder to complete the crunch, and the muscles were strengthened and conditioned accordingly.

U.S. Pat. No. 5,224,914 disclosed an abdominal exercise device for a seated user including a leg engaging member, a chest engaging member, resilient spring members coupled between the leg engaging member and the chest engaging member, and a pair of hand engaging members extending rearwardly from the chest engaging members. The exercise device was positioned on the seated user with the leg engaging member resting on the thighs of the user, and the chest engaging member abutting the chest of the user. The user grasped the hand engaging members to maintain the arms of the user against the upper torso of the user, and to maintain the hands of the user adjacent to the chest. Subsequently, the body of the user was bent forwardly at the waist while contracting the abdominal and lower back muscles to cause the chest engaging member to be brought toward the leg engaging member. The spring members resisted the movement of the chest engaging member relative to the leg engaging member to increase the effectiveness of the crunch exercise.

Although the prior known exercise devices were capable of facilitating the performance of crunch exercises to strengthen the abdominal and lower back muscles of the user, all of the prior known exercise devices suffered from the same serious drawback, in that they could inadvertently cause injury to the user. Also, such devices could aggravate or increase the extent of existing injuries to the lower back muscles. In this regard, people with injuries to the lower back muscles were susceptible to further injury by performing the standard crunch exercise.

As a result, it has been advisable for people with existing muscle injuries to avoid exercising the abdominal and lower back muscles until such time that the injuries had healed, and even then such person would be susceptible to re-injury.

The back and abdominal muscle group comprises several individual muscles, with each muscle contributing to the overall health and wellness of the back and abdomen. For example, the abdomen has a vertically positioned main muscle and diagonally positioned oblique muscles. The main muscle interacts with the oblique muscles to provide strength and support in bending, reaching, and lifting. In the prior art, the main muscle receives some amount of exercise with the "crunch" type motion, although the exercise is accompanied with the risks discussed above. Further, the forward motion of the crunch exercise fails to adequately address the needs of the diagonally positioned oblique muscle. By failing to properly address other muscles in the back and abdomen, the prior art exercises provide an incomplete workout for the back and abdomen, resulting in diminished health.

Further, people of varying builds need to tone and strengthen their back and abdomen areas. However, optimum exercise benefit only comes from using an exercise device when it is properly sized and placed on a particular individual. In particular, proper placement of the crunch-type exercise device is dependent on an individual's torso length. Since torso length affects the distance from the lap to the chest, an individual's torso length determines how much the user must bend to use the device. It is unrealistic that a person with a long torso can effective use an exercise device sized to a person with a shorter torso length. In such a situation the person with the long torso length will be forced to bend forward to grasp and position the exercise device, while a person with a short torso length will have to uncomfortably extend. Using the device in such positions not only results in a less effective workout, but may even contribute to the risk of injury in using the prior art devices.

Therefore, it would be highly desirable to have a new and improved exercise device for exercising the abdominal and lower back muscles of a user, without performing a crunch type of exercise, in accordance with a novel method and exercise device. Such an exercise device should facilitate strengthening the abdominal and lower back muscles in a safe and convenient manner. It is also desirable that the exercise device work on other muscles in the area including the oblique muscles. The device should facilitate the exercising of the muscles in an effective manner, with little or no risk of injury to the user, or of re-injuring or aggravating old injuries. It would be desirable to have such a device which could be used conveniently while seated in a chair, without the need of having the user wear exercise or other leisure type clothing. Also, such a device should be compact in size and light in weight so that it can be readily transported, or stored away when not in use. Further, it would be advantageous if the device could not only be fitted to users of varying torso length.

SUMMARY OF THE INVENTION

Therefore, the principal object of the present invention is to provide a new and improved exercise device for exercising abdominal and lower back muscles in a relatively safe but effective manner.

Another object of the present invention is to provide such a new and improved device and method of performing the exercises, wherein the exercise device is used in a seated position, and the device is compact in size and transportable.

Another separate object of the present invention is to provide an exercise device and method that strengthens the oblique abdomen muscles.

It is another separate object of the present invention to provide an exercise device that accommodates users with different torso lengths so each user may use the device safely, effectively, and comfortably.

Briefly, the above and further objects of the present invention are realized by providing a new and improved exercise device which can be used by a seated user to exercise the abdominal and lower back muscles according to a novel method of the present invention.

An inventive exercise device is disclosed for facilitating the strengthening of abdominal and back muscles, and includes a resistance member coupled between a lap engageable base and an arm positioning member. The arm positioning member helps to maintain the back of the user in a substantially upright position as the arm positioning member applies and releases reciprocatively and alternatingly in a substantially vertical path of travel of the upper body of the user against the force on the resistance member during repetitions of use of the device.

The resistance member resists substantially vertical downward movement relative to the base member to enhance the development of muscle strength by enabling the upper body of the user to contract and expand reciprocatively vertically without leaning forwardly in a safe and effective manner.

In a separate aspect of the present invention, the inventive exercise device has swivel means connecting the arm positioning member to the base that allows the exercise device to be used while the user leans left or leans right, thus exercising the oblique muscles.

In yet another aspect of the present invention, the inventive exercise device has a torso adjustment means for adjusting where the arm positioning member contacts the upper body of the user so that the inventing device can accommodate a wide variety of different sized users.

In another separate aspect of the present invention, an exercise device is provided with a swivel to allow the user to comfortably sit in a natural sitted position while performing the back and abdominal exercise.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
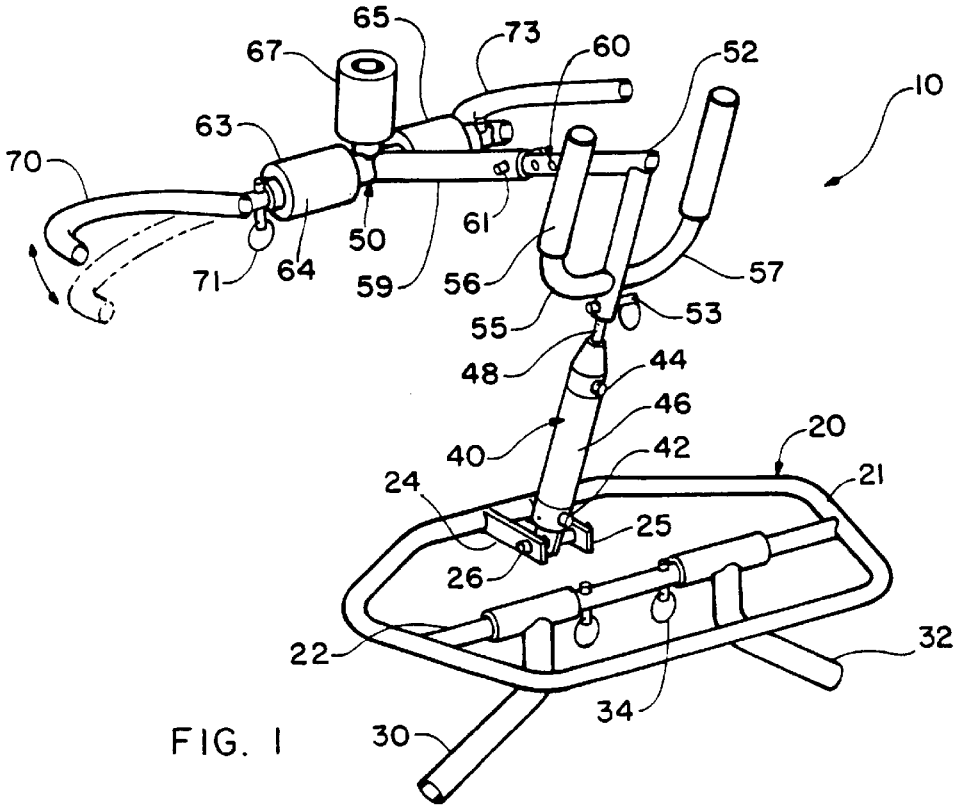
FIG. 1 is a pictorial view of an exercise device, which is constructed in accordance with the present invention.

Referring to the drawings and more particularly FIG. 1 thereof, there is shown an exercise device 10 which is constructed in accordance with the present invention. The exercise device 10 can be utilized for conditioning abdominal and lower back muscles of a user 2 while seated in a chair 4 or other suitable seat (not shown), in accordance with the method of the present invention.

The exercise device 10 generally includes a lap engaging frame or base 20 for supporting the device 10 on the lap of the user 2 while seated in the chair 4. A resistance device or member 40 is coupled at one of its ends to the lap engaging frame 20 for providing the resistance during exercising. An arm positioning member or brace 50 coupled to the resistance device 40 at another end thereof, helps to position the arms in an L-shaped configuration (FIG. 2) with the upper arm portions abutting or engaging snugly the upper torso of the user and the forearms extending forwardly away from the body of the user 2. The resistance member 40 helps to resist vertical movement of the arm positioning member 50 relative to the lap engaging frame 20 to help tone and strengthen the muscles of the user 2 in a safe and effective manner.

Figure 2:
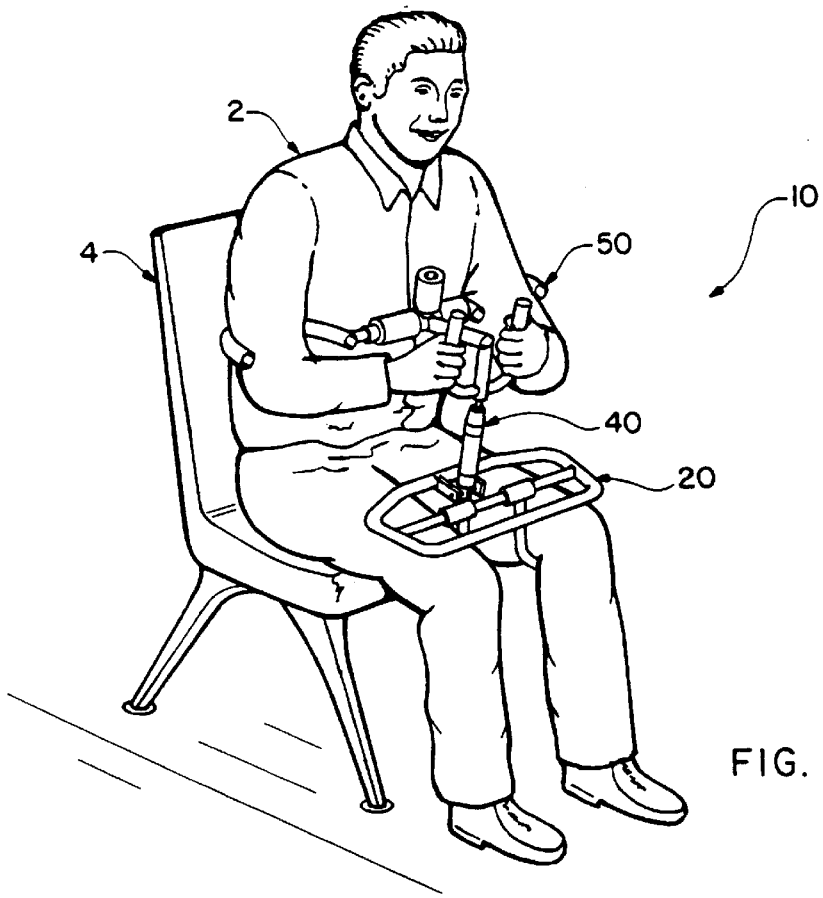
FIG. 2 is a reduced scale view of the device FIG. 1, illustrating it during use.

As best seen in FIG. 2, the exercise device 10 is adapted for use by the user 2 sitting in a substantially upright position on a chair 4. The lap engaging frame 20 is disposed in a generally horizontal position on the lap of the seated user 2 with the arm positioning member 50 arranged in a generally horizontal disposition engaging the chest of the user 2 in an initial or rest position. The upper arms and hands of the user 2 engage the arm positioning member 50 to position the arms in a generally L-shaped configuration. The inner thighs of the user 2 engage the lap engaging frame 20 and apply inwardly directed forces thereon.

In accordance with the present invention, the user 2 sits in the upright position with the abdominal and lower back muscles relaxed. Subsequently, the user contracts the abdominal and the lower back muscles directly downwardly against the force of the generally upright resistance member 40 to apply a substantially downward vertical force to the resistance member 40. The lap engaging frame 20 braces the upright resistance member 40 and resists it from moving downwardly under the force applied by the arm positioning member 50. At the same time, the resistance member 40 resists the vertical force applied by the arm positioning member 50, causing the abdominal and lower back muscles to exert additional contracting action.

The exercise is completed by relaxing the abdominal and lower back muscles while raising the arm positioning arrangement 50 relative to the lap engaging frame 20 until the arm positioning arrangement 50 returns to the initial relaxed position. This cycle of operation is then repeated as many times as desired.

During the entire exercise, the user 2 remains in the substantially upright position with the elbows adjacent to the body and the forearms at about right angles to the body, thereby reducing the risk of muscle injury to the user. The exercise can be repeated as desired to further condition the abdominal and lower back muscles. When the exercise has been completed, the exercise device 10 can be stored in a compact manner for use at a later time as hereafter described in greater detail.

In summary, in accordance with the method of the present invention, while sitting in the chair 4 with the frame 20 positioned on his or her lap, the user 2 sits in an upright position with his or her back straight. The user then contracts his or her upper body directly vertically downwardly against the force of the upright resistance member 40, without leaning forwardly in the conventional crunch movement. Thus, the back is protected from injury, since the undesirable and unwanted crunch movement is avoided, and yet the abdominal and lower back muscles are exercised in a safe and effective manner.

During the vertical downward body contracting movement by the user, the thighs press inwardly on the frame 20 to stabilize it and to maintain the upper body of the user in a generally vertical position during the repeated up and down movements of the body. Additionally, the arm positioning member 50 facilitates causing the user to press his or her arms inwardly against his or her torso to maintain the erect vertical position of the user's body during the repetitions of the exercise operation.

Thus, the repeated up and down contractions and expansions of the upper body against the resistance device 40, without leaning forwardly provides a vigorous exercise of the abdominal and lower back muscles in a safe and effective manner.

In the preferred form of the invention, the resistance device 40 provides resistance in both the upward and downward directions. Thus, during the final phase of the exercise, when the user raises the arm positioning member 50 relative to the lap engaging frame 20, the user is required to apply a sufficient upwardly directed force with the arm positioning member 50 to overcome the resistance supplied by the resistance member 40.

It will be understood by one skilled in the art that the resistance member 40 may provide resistance against movement in one direction only. For example, the resistance member 40 resists downward vertical movement only to facilitate conditioning the abdomen and lower back muscles. During the final phase of the exercise when the user is raising the arm positioning member 50 relative to the lap engaging frame 20, the resistance member 40 could provide little or no resistance.

Considering now the exercise device 10 in greater detail with reference to FIG. 1, the lap engaging frame 20 includes an annular rim member 21 adapted to rest comfortably on the lap of the user 2, and to provide stability for the exercise device 10 during an exercise routine. The rim member 21 is generally composed of a rigid material, such as aluminum tubular material. A tubular central support or cross member 22 extends between and is affixed to opposing sides of the rim member 21 to support a pair of generally outwardly curved thigh brace members 30 and 32. The thigh brace members 30 and 32 are adapted to engage and bear forcibly against the inner thighs of the user 2, and depend from and are positionable along the length of the central support member 22 to accommodate the user 2. The thigh brace members 30 and 32 are pivotable at their upper ends about the support member 22 to swing upwardly against the rim member 21 to facilitate reducing the size requirements of the device 10 for storage purposes. A pair of removable pins such as a pin 34 cooperate with openings (not shown) in the central support member 22 to limit the movement of the thigh braces 30 and 32 along the length of the support member 22 adjustably to fit a given user.

The lap engaging frame 20 further includes a pair of spaced apart support Clevus bracket brackets 24 and 25 extending inwardly from rim member 21 for helping to couple the resistance member 40 pivotally to the lap engaging frame 20. A pivot pin 26 extending through an opening (not shown) in one end of the resistance member 40, and through the support brackets 24 and 25, substantially fixes the resistance device 40 relative to the lap engaging frame 20 while permitting the resistance device 40 to pivot relative to the lap engaging frame 20 during use of the device 10.

The resistance device 40 is preferably a piston cylinder assembly and includes a cylinder 46 which receives reciprocatively a piston 48 therein. The resistance provided by the resistance member 40 against the piston 48 being urged inwardly into the cylinder 46 is controlled adjustably by an adjustment member 42 (FIG. 1). Similarly, the outwardly movement of the piston member 48 relative to the cylinder member 46 is controlled adjustably by an adjustment member 44 (FIG. 1). Other devices for resisting movement, such as compression spring devices (not shown), could also be used to provide resistance of the vertical movement of the arm positioning member 50 relative to the lap engaging frame 20.

The arm positioning member 50 includes an L-shaped support member 52 coupled to the piston member 48 of the resistance member 40 by a removable pin 53. The pin 53 can be removed to separate the arm positioning member 50 from the piston member 48 and the frame 20 when storing or transporting the device 10. A tubular member 59 receives telescopically and adjustably the end of the horizontal portion of the L-shaped support member 52 by a removable pin 61 extending through a pair of aligned holes (not shown) in the member 59 and a selected one of a pair of aligned holes such as the holes 60 (FIG. 1) in the member 52. Thus, the plurality of openings through the support member 52 cooperate with the pin 61 to enable the position of the chest engaging member 59 relative to the L-shaped support member 52 to be adjusted to suit the user 2. The chest engaging member 59 includes a pair of oppositely disposed lateral brace members 63 and 65 and a transverse brace member 67 to form a T-shaped end which receives the chest. To enhance the comfort of the user 2, the lateral brace members 63 and 65, and the transverse brace member 67, are covered with a padding material 64.

A pair of generally U-shaped hook or elbow brace members 70 and 73 are connected to respective ends of the lateral brace members 63 and 65 by an associated removable pin, such as the pin 71. The pins are removable in a manner similar to the pin 53, to permit the brace members 70 and 73 to be removed from the respective members 63 and 65 for storage and transportation purposes and render the brace members 70 and 73 adjustable in the overall distance between the members 70 and 73 to accommodate different users, depending on their size. In this regard, the members 70 and 73 engage the respective brace members 63 and 65 telescopically and axially adjustable. In so doing, the connections are also adjustable rotatably angularly so that the members, such as the member 70, can be positioned downwardly angularly as indicated in broken lines in FIG. 1. In such lower positions, the members 70 and 73 are engaged at a lower position on the arms of the user near the elbows so that the chest engageable members 63, 65 and 67 do not engage the chest of the user for the comfort of the user. The elbow brace members 70 and 73 receive the upper arms at about the elbows, and help position the upper arms against the upper torso of the user 2. Extending outwardly and upwardly from the L-shaped support member 52 are a pair of hand brace member 55 and 57. The hand brace members 55 and 57 position the hands away from the body to position the arms in an L-shape, and help to apply the substantially vertical force on the resistance member 40 by the arm positioning member 50. Hand grips, such as the hand grip 56, can be provided on the hand brace members 55 and 57 to enable the user 2 to more easily grasp the hand brace members 55 and 57.

Figure 3:
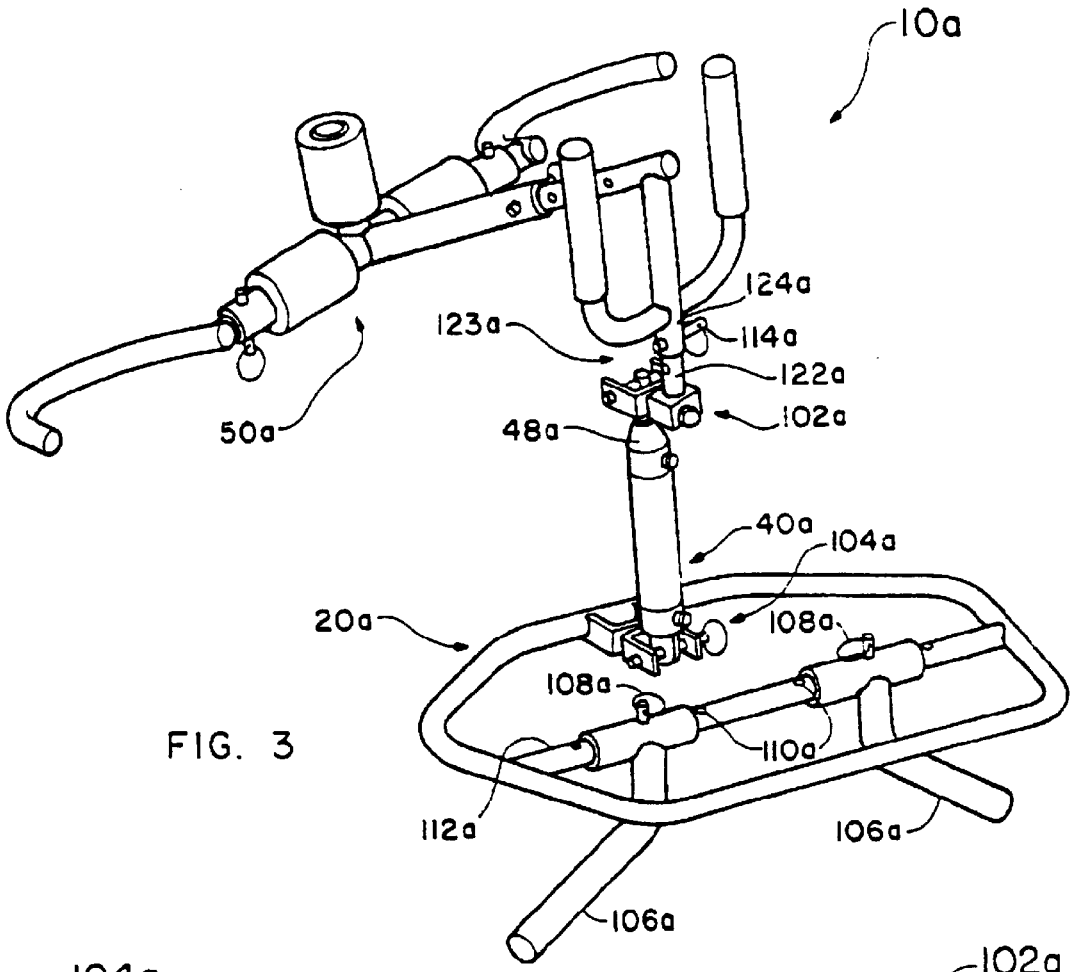
FIG. 3 is a pictorial view of another exercise device, which is also constructed in accordance with the present invention.

FIG. 3 shows an exercise device 10*a* which is also constructed in accordance with the present invention. Device 10*a* is similar to device 10, but permits the exercise of the oblique abdominal muscles. Further, device 10*a* is adjustable for users of varying torso length, and also permits a user to comfortably exercise while sitting straight or while leaning forward.

The device 10*a* has a lap engaging frame 20*a* similar to the lap engaging frame 20, a resistance device member 40*a* similar to resistance device member 40 and an arm positioning member or brace 50*a* similar to arm positioning member or brace 50. Device 10*a* is also positioned on the user similar to the manner device 10 is positioned on the user as shown in FIG. 2. However, exercise device 10*a* as shown in FIG. 3 comprises a torso adjustment assembly 123*a* and swivels 102*a* and 104*a* for fitting the exercise device 10*a* to the needs of a particular user.

As with device 10, the device 10*a* may be used with the user sitting in an upright position. However, the swivels 102*a* and 104*a* also permit the user to exercise the oblique abdominal muscles by using the device 10*a* while leaning left or leaning right. More specifically, device 10*a* has an upper swivel 102*a* connecting the arm position member or brace 50*a* to the resistance member 40*a*, with lower swivel 104*a* connecting the resistance member 40*a* to the lap engaging frame 20*a*. Thereby, device 10*a* exercises a wider range of back and abdominal muscles, thus providing a more complete stimulus, toning, and strengthening to the back and abdominal muscle group.

Device 10*a* also has a torso adjustment assembly 123*a*. The torso adjustment assembly 123*a* accommodates users with differing torso lengths. By allowing for such adjustment, users may adjust the device 10*a* so they may maintain a comfortable and safe exercise position.

To further increase comfort, effectiveness, and safety, the device 10*a* also comprises swivels 102*a* and 104*a*. The swivels 102*a* and 104*a* permit the user to sit and perform the back and abdominal exercise while maintaining a comfortable sitting position. The device 10*a* will now be addressed in more detail.

Referring to FIG. 3, the arm positioning member or brace 50*a* of device 10*a* swivels relative to lap engaging frame 20*a*. Such freedom of movement is provided by the swivels 102*a* and 104*a*. The swivels 102*a* and 104*a* both permit the user to use device 10*a* while seated in an upright position, and permit the user to use device 10*a* while leaning left or leaning right.

Figure 4:
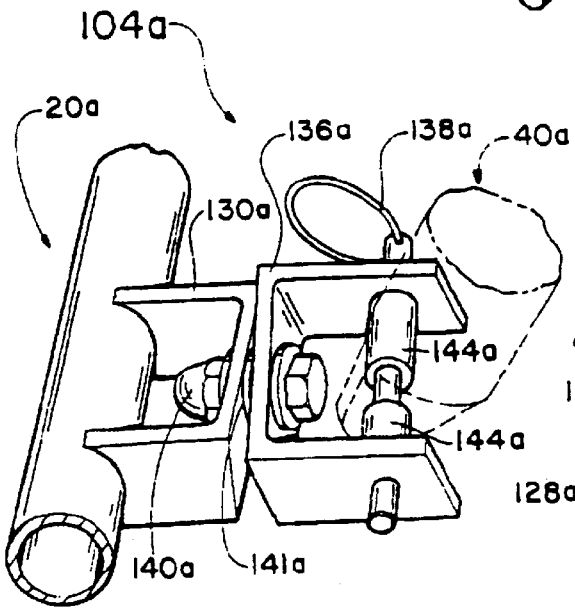
FIG. 4 is an enlarged, fragmentary detail view of the device of FIG. 3, illustrating the lower swivel for the device shown in FIG. 3.
Figure 5:
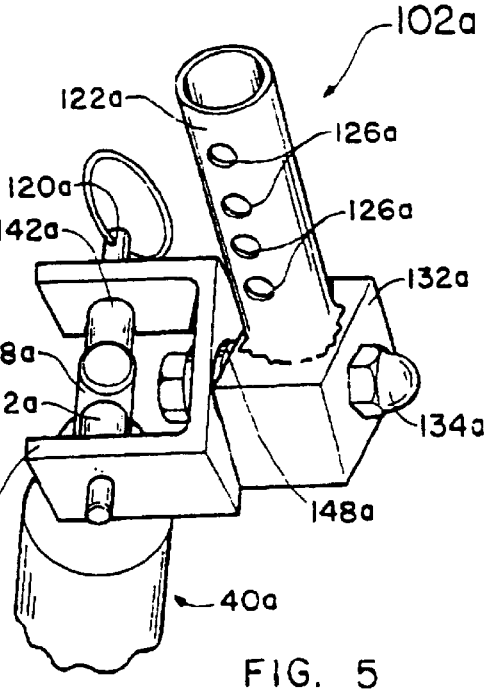
FIG. 5 is an enlarged, fragmentary detail view of the device of FIG. 3, illustrating the upper swivel for the device shown in FIG. 3.

The swivels 102*a* and 104*a* are shown in FIG. 3 and detailed in FIGS. 4 and 5. Upper swivel 102*a* is positioned between the arm positioning member or brace 50*a* and the resistance device or member 40*a*. As shown in FIG. 5, the upper swivel 102*a* attaches the piston 48*a* to the inner torso adjustment tube 122*a*. FIG. 5 shows that the upper swivel 102*a* has a piston upper Clevus bracket 128*a* that attaches with pin 120*a* to the piston 48*a*. Washers 142*a* act to position the piston 48*a* centrally within the piston upper Clevus bracket 128*a*. The device 10*a* may be disassembled at this point as pin 120*a* is removable. Piston upper Clevus bracket 128*a* therefore rotates about the axis of the pin 120*a*. The piston upper Clevus bracket 128*a* connects to an arm member swivel 132*a* with a bolt 134*a*. A friction spacer 132*a* sits on the bolt 134*a* between the piston upper Clevus bracket 128*a* and the arm member swivel 132*a*. The friction spacer 132*a* allows the arm member swivel 132*a* to more freely rotate about the axis of the bolt 134*a*. The inner torso adjustment tube 122*a* is attached to the arm member swivel 132*a*. The piston upper Clevus bracket 128*a* and the arm member swivel 132*a* rotate in orthogonal planes, thus providing a swivel motion.

FIG. 4 shows lower swivel 104*a*. Lower swivel 104*a* has a thigh brace Clevus bracket 130*a* attached to the lap engaging frame 20*a*. A piston lower Clevus bracket 136*a* is connected to the thigh brace Clevus bracket 130*a* with bolt 140*a*. Friction spacer 146*a* sits between the piston lower Clevus bracket 136*a* and the thigh brace Clevus bracket 130*a* allowing the piston lower Clevus bracket 136*a* to rotate substantially freely relative to the thigh brace Clevus bracket 130*a*. The piston 48*a* is attached to the piston lower Clevus bracket 136*a* with pin 138*a*. Washers 144*a* position the piston 48*a* in the center of the piston lower Clevus bracket 136*a*. Pin 138*a* is removable to accommodate disassembly of the device 10*a*. As the lower swivel 104*a* accommodates rotations in two orthogonal planes, a swivel motion is accomplished.

With the motion allowed by swivels 102*a* and 104*a*, a user may freely lean to the left or lean to the right and obtain an exercise result maintaining his or her back at a nearly constant forward angle relative the seating surface.

Those skilled in the art will readily recognize several alternatives exist to the upper and lower swivels disclosed herein.

Referring to both FIGS. 3 and 5, the torso adjustment assembly 123*a* is positioned on the arm positioning member or brace 50*a*. The torso adjustment assembly 123*a* comprises an outer torso adjustment tube 124*a*, an inner torso adjustment tube 122*a*, and a pin 114*a*. The inner torso adjustment tube 122*a* is slideably retained within the outer torso adjustment tube 124*a*, thus providing a telescoping assembly for adjusting the length of the torso adjustment assembly 123*a*. Both the inner and outer torso adjustment tubes have corresponding holes 126*a* for accepting pin 114*a*. With pin 114*a* removed, the inner and outer torso adjustment tubes slide relative to each other, thus extending or contracting the inner torso adjustment tube 122*a* relative to the outer torso adjustment tube 124*a*.

With the user seated in the proper exercise position, the user removes the pin 114*a* and moves into a comfortable exercise position. The user then makes a slight upward or downward adjustment until pin 114*a* may be inserted through both the outer torso adjustment tube 124*a* and the inner torso adjustment tube 122*a*. With the pin 114*a* in place, the arm positioning member or brace 50*a* is positioned the proper distance from the lap engaging frame 20*a* thus allowing the user to more easily maintain a comfortable position. The torso adjustment assembly 123*a* thereby accommodates users having different upper body or torso lengths.

Figure 6:
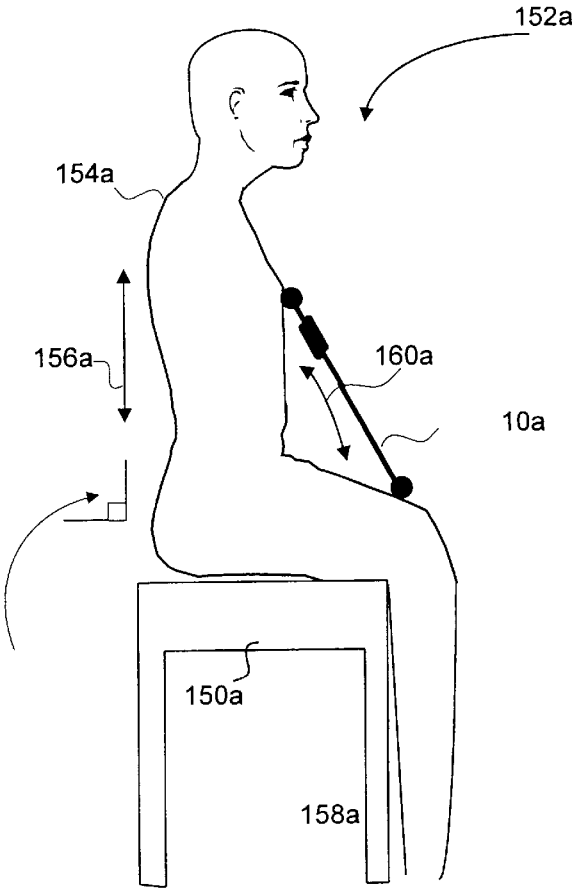
FIG. 6 is a diagrammatic side view of a user sitting with a perpendicular back using the exercise device shown in FIG. 3.

FIG. 6 shows a user 152*a* sitting substantially straight upright in a natural sitted position on a seating surface 150*a*.

The user 152*a* is in an exercise position with the exercise device 10*a* positioned between the chest and thigh. The user's back 154*a* is substantially perpendicular to the seating surface 150*a*. As the user 152*a* performs the back and abdominal exercise, the back moves substantially along the reciprocative generally vertical exercise motion 156*a* and yet enables a desired crunch motion, and yet avoids the undesirable forward bending reciprocating motion as indicated at 160*a*. Such motion 160*a* can cause injury to the back of the user.

Figure 7:
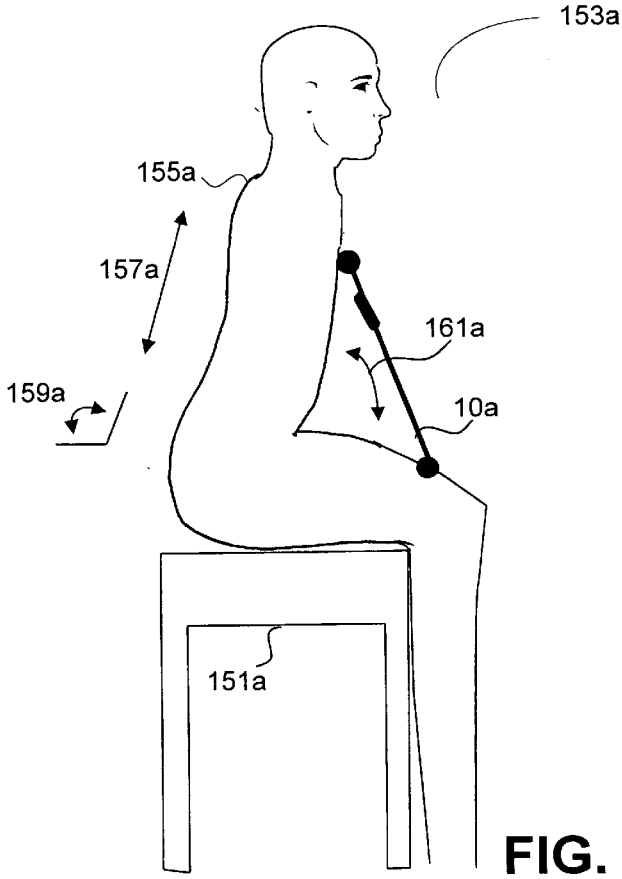
FIG. 7 is a diagrammatic side view of a user sitting with a forwardly angled back using the exercise device shown in FIG. 3.

However, not all users can comfortably sit straight upright and perform a back and abdominal exercise. Therefore the device 10*a* has swivels 102*a* and 104*a* to accommodate these users' natural tendency to sit with a slight forward angle. As shown in FIG. 7, a user 153*a* is sitting in a natural upright position with a slight forward angle relative to a seating surface 151*a*. The user 153*a* is in an exercise position with the exercise device 10*a* again positioned between the chest and thigh. The user's back 155*a* has a forward angle 159*a* relative the seating surface 151*a*. As the user 153*a* performs the back and abdominal exercise, the back moves substantially along the exercise motion 157*a* yet enables a desired crunch motion, but yet avoids the undesirable forward bending reciprocating motion as indicated at 161*a*. Such motion 161*a* can cause injury to the back of the user. Thus the user is able sit upright in a comfortable straight or forward leaning position and use the exercise device 10*a*.

Referring again to FIG. 3, thigh brace members 106*a* are shown slideably attached to the central support or cross member 112*a*. The central support or cross member 112*a* has holes 110*a* at various points on its length corresponding to a hole in the thigh brace members 106*a*. A pin 108*a* extends through the thigh brace member 106*a* and the central support or cross member 112*a* to securely position the thigh brace members 106*a* at a selected position on the central support or cross member 112*a*. Thus, a user may securely position the thigh brace members 106*a* at a convenient and adjustable position.

To use the exercise device 10*a*, the user positions the thigh brace members 106*a* conveniently and comfortably against the thighs. The lap engaging frame 20*a* is therefore positioned on the lap of the user, with the piston directed toward the user's chest. The user positions the arm positioning member at the chest area and places the hands on the hand supports. The user now adjusts the torso adjustment assembly 123*a* to vary where the arm positioning member engages the chest area. Once the user has the device 10*a* adjusted to match that user's torso length, the user takes a comfortable exercise position. This position may be with the user sitting with the back perpendicular to the sitting surface, or, since some users have a natural tendency to lean forward, this comfortable exercise position may be with the back leaning slightly forwardly. Since the arm positioning member is connected to the lap engaging frame with a swivel, the user has the freedom of movement to move into a comfortable position with the user's back having an initial angle relative the sitting surface.

With the device now adjusted and the user in a comfortable position, the user begins the back and abdomen exercise. The exercise, as with device 10, is done by applying and releasing repeatedly a force by using the arm positioning member and contracting and expanding repeatedly and reciprocatively the upper body without substantially changing the initial angle of the back. The user not only performs this exercise while sitting upright, but also performs the exercise while leaning to the left and leaning to the right to exercise the oblique abdominal muscles.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An exercise device to exercise the abdominal and oblique muscles for a user sitting on a surface, the device comprising:

a horizontal lap engageable base member for resting on the lap of the user;

a horizontal arm positioning means engaging the upper body of the user;

a resistance means operably connecting the base member to the arm positioning means;

a swivel cooperating with the resistance means for placing the arm positioning means relative to the base member so that the user sits with the user's back at a comfortable angle relative to the surface;

wherein the arm positioning means applies a force to the resistance means so that the user's upper body contracts and expands without substantially altering the comfortable angle, thereby exercising the muscles of the user in a safe and effective manner; and further including a thigh brace arrangement connected to the base member.

2. An exercise device according to claim 1 where the resistance means further comprises a top and a bottom and the swivel connects the bottom of the resistance means to the base member.

3. The exercise device according to claim 2 further comprising a second swivel connecting the top of the resistance means to the arm positioning means.

4. The exercise device according to claim 1 wherein the swivel permits the arm positioning means to move left or move right relative the base member so the user may exercise the abdominal and oblique muscles while leaning to the left or leaning to the right.

5. An exercise device according to claim 1 further comprising a torso adjustment means to adjust where the arm positioning means engages the upper body of the user, thereby assisting the user in maintaining a safe and effective exercise position.

6. The exercise device according to claim 5 wherein the torso adjustment means is a telescoping assembly.

7. The exercise device according to claim 6 where the telescoping assembly further comprises an inner torso tube slideably retained in an outer torso tube wherein a removable pin extends through the tubes to restrict telescopic motion.

8. An exercise device according to claim 1 wherein the resistance means includes a piston cylinder assembly.

9. An exercise device according to claim 8 where the piston cylinder has a top and a bottom and wherein the top is connected to the arm positioning means with a second swivel and the bottom is connected to the base member with the swivel.

10. An exercise device for a user, the user seated on a surface with the user's back having an initial angle relative the surface and the user capable of leaning left and leaning right, the exercise device comprising:

a lap engageable base member;

a chest engageable member for contacting the device to the user at an upper body position;

a resistance means offset from the chest engageable member and connecting the base to the chest engageable member for providing an exercise force;

an elbow brace member connected to the chest engageable member;

swivel means operably connecting the base to the chest engageable member wherein the chest engageable member is positionable at the upper body position while the user leans left or the user leans right so that the base remains substantially parallel to the seating surface; and a hand brace member spaced apart from the chest engageable member for cooperating with the elbow brace arrangement to apply the force enabling the upper body of the user to contract and expand reciprocatively without substantially changing the angle of the user's back.

11. An exercise device according to claim 10 further comprising a torso adjustment means operably connected to the chest engageable member for adjusting the position where the chest engageable member contacts the upper body thereby adjusting the device to the user's torso length.

12. An exercise device according to claim 10, wherein the resistance means includes a piston cylinder assembly.

13. An exercise device according to claim 12, wherein the piston cylinder assembly is attached with a first swivel to the chest engageable member and attached to the base member with a second swivel.

14. An exercising device according to claim 10 further comprising a first swivel operably connecting the chest engageable member to the resistance means, and a second swivel operably connecting the resistance means to the base member.

15. An exercise device according to claim 10 further comprising swivel means operably connected to the resistance means wherein the user leans either forward or backward to select the initial back angle.

16. An exercise device according to claim 15 wherein the initial back angle is either perpendicular or forward relative to the seating surface.

17. An exercise device according to claim 1, further including;

a torso adjustment assembly for adjusting where the arm positioning means engages the upper body of the user, the torso adjustment assembly permitting the user's back to obtain a comfortable angle relative the seating surface.

18. The exercise device according to claim 17 wherein the torso adjustment means is a telescoping assembly.

19. The exercise device according to claim 18 where the telescoping assembly further comprises an inner torso tube slideably retained in an outer torso tube wherein a removable pin extends through the tubes to restrict telescopic motion.

* * * * *